US005488903A

United States Patent [19]

Köbler et al.

[11] Patent Number: 5,488,903

[45] Date of Patent: Feb. 6, 1996

[54] REGISTER DEVICE FOR A SLEEVE-SHAPED OFFSET PRINTING FORM

[75] Inventors: Ingo Köbler, Anhausen; Anton Stadlmair, Kühbach; Helmut Stuhlmiller, Altenmünster; Alfons Grieser, Sielenbach, all of Germany

[73] Assignee: MAN Roland Druckmaschinen AG, Offenbach, Germany

[21] Appl. No.: 242,174

[22] Filed: May 13, 1994

[30] Foreign Application Priority Data

May 13, 1993 [DE] Germany ..... 43 15 996.6

[51] Int. Cl.[6] ..... B41F 13/12; B41F 27/06; B41F 27/12

[52] U.S. Cl. ..... 101/375; 101/378; 101/395; 101/DIG. 36; 492/48; 29/895.23

[58] Field of Search ..... 101/216, 217, 101/375, 376, 378, 382.1, 383, 389.1, 395, 415.1, DIG. 36; 492/48; 29/895.21, 895.23

[56] References Cited

U.S. PATENT DOCUMENTS

| | | | |
|---|---|---|---|
| 637,562 | 11/1899 | Hett | 101/375 |
| 661,142 | 11/1900 | Grasser | 101/375 |
| 662,861 | 11/1900 | Hett | 101/212 |
| 758,486 | 4/1904 | Such | 101/375 |
| 1,690,684 | 11/1928 | Johnson | 29/895.21 |
| 4,378,737 | 4/1983 | Kirkpatrick | 101/375 |
| 4,934,266 | 6/1990 | Fantoni | 101/375 |
| 4,964,338 | 10/1990 | Fantoni et al. | 101/378 |
| 5,138,923 | 8/1992 | Kent et al. | 492/21 |

FOREIGN PATENT DOCUMENTS

| | | | |
|---|---|---|---|
| 181726 | 5/1986 | European Pat. Off. | 101/375 |
| 3532099 | 3/1987 | Germany . | |
| 4140768 | 6/1993 | Germany . | |
| 449855 | 7/1936 | United Kingdom | 101/375 |
| 578777 | 7/1946 | United Kingdom | 101/375 |

OTHER PUBLICATIONS

*"Der Tiefdruck"*, Alexander Braun, p. 91, 1952.

*Primary Examiner*—Stephen Funk
*Attorney, Agent, or Firm*—Cohen, Pontani, Lieberman & Pavane

[57] ABSTRACT

For the register of a sleeve-shaped offset priming form in which the beginning and end of the plate-shaped blank of the printing form are connected by a weld seam, a guide element in the form of a projection is provided for the sleeve at the inside of the sleeve. A form cylinder which can be used in combination with the sleeve has a groove extending along its entire width, which groove has a depth that is greater than the height of the projection. The projection can be inserted completely into the groove so that the sleeve can be secured on the form cylinder in the circumferential direction.

9 Claims, 3 Drawing Sheets

REGISTER DEVICE FOR A SLEEVE-SHAPED OFFSET PRINTING FORM

BACKGROUND OF THE INVENTION

1. Field of the Invention

The invention is directed to a register device for a sleeve-shaped offset printing form made of metallic material for a form cylinder of a printing press, which form cylinder has no clamping groove or clamping segment for plate lock-up devices. The beginning and end of a plate-shaped blank of the printing form are connected with one another by means of a weld seam so that the offset printing form encloses the form cylinder continuously as a sleeve in a friction-locking manner in the working position, but is detachable therefrom.

2. Description of the Prior Art

German Patent Application P 41 40 768.7-27 discloses a printing form of the above-mentioned type produced from a metallic work material in which register devices are provided in the form of a dowel hole or fitting hole system at least at one end side of the form in order to ensure accurate register circumferentially and laterally. This priming form can be used in combination with a form cylinder having no groove or clamping segment. At its surface, the form cylinder has register pins which cooperate with the fitting holes of the printing form. The sleeve-shaped printing form can be slid onto the form cylinder by using compressed air. Nevertheless, when in the working position on the form cylinder so as to be fixed with respect to displacement, it can easily be detached therefrom without damage and can accordingly be reused.

SUMMARY OF THE INVENTION

Proceeding from this background, the object of the present invemion is to provide a simpler register device for a sleeve-shaped printing form of the generic type.

Pursuant to this object, and others which will become apparent hereafter, one aspect of the present invention resides in a register device having a guide element that projects toward the inside of the sleeve at least along a portion of the sleeve width. The form cylinder has an axially extending groove into which the guide element is insertable so that the sleeve can be secured on the form cylinder.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

DETAILED DESCRIPTION OF THE PREFERRED EMBODIMENTS

Figure 1:
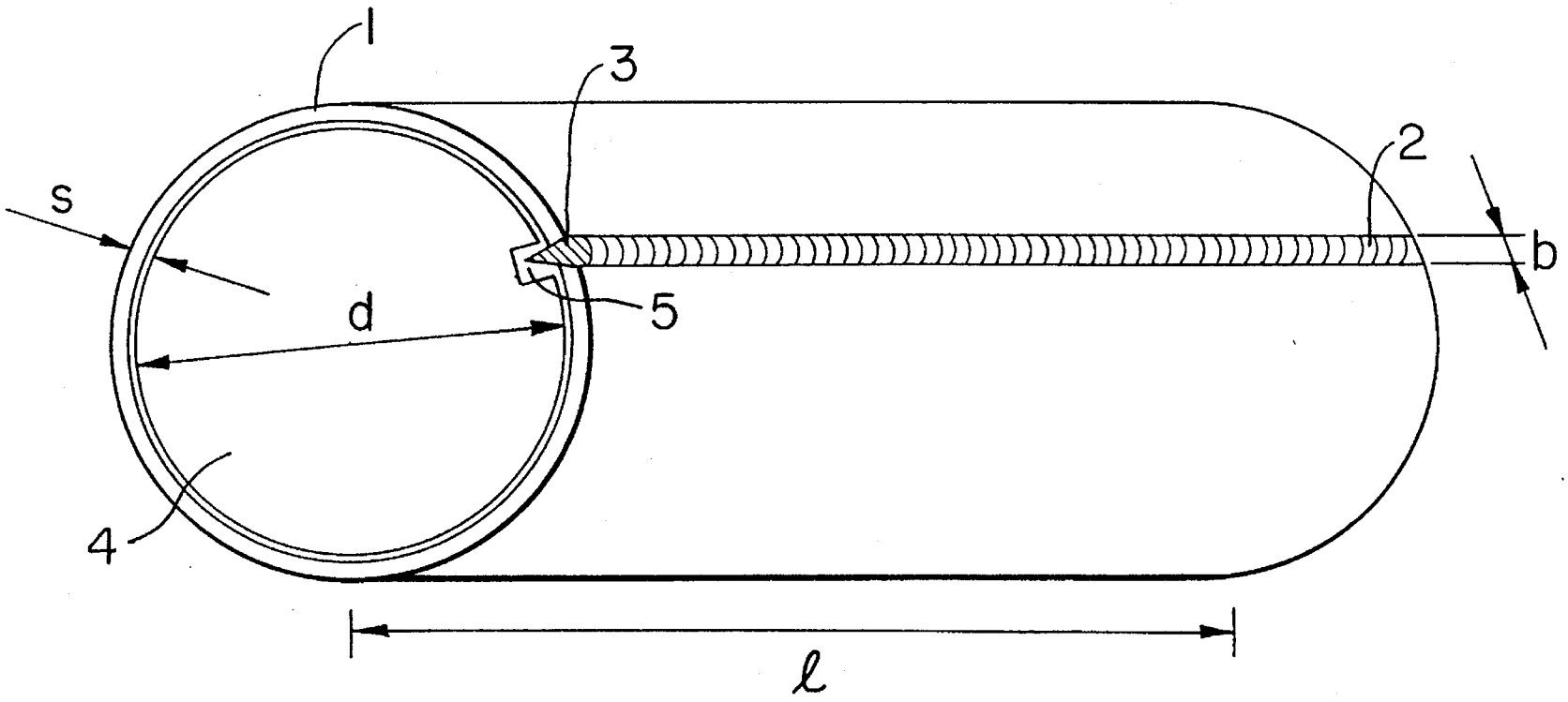
FIG. 1 shows a perspective view of a sleeve-shaped offset printing form on a form cylinder with a register device according to the invention.

In FIG. 1, a thin offset printing form 1 with a thickness s of approximately 0.3 mm, specifically for the present embodiment, is shaped from a metallic material to form a sleeve with a diameter d of approximately 300 mm and a width 1 of approximately 1600 mm. The work material can be aluminum or a multimetal or trimetal material. The beginning and end of the plate-shaped blank of the offset printing form 1 are welded together lengthwise. The weld seam 2 preferably has a width b in the order of magnitude of approximately 1 mm and is advantageously concave at its outer side with reference to the sleeve 1. At its inner side the weld seam protrudes in a wedge-shaped manner along the entire width 1 of the printing form as a guide element, i.e. it preferably has a wedge-shaped projection 3. The projection 3, in the form of a wedge with a triangular cross section, projects into a fitting groove 5 incorporated in the form cylinder 4 which can be used in combination with the sleeve 1. The depth of this fitting groove 5 is greater than the height of the projection 3 of the weld seam 2 and the width of the fitting groove 5 is at least equal to the maximum width of the projection 3, but roughly corresponds to the width of the wedge projection 3.

The projection 3 can be inserted completely into the groove 5 when the sleeve 1 is placed on the form cylinder 4 so that the printing form 1 can be secured on the form cylinder 4 in the circumferential direction.

The weld seam 2 is preferably produced by means of a Nd-YAG laser. The adjustment of the laser output and the possibility of a continuous pulsed operating mode allows a controlled and exactly reproducible application of energy to the printing form 1. Heat loading and distortion of the weld material are extremely low in comparison with other thermal processes.

The sleeve 1 is placed on the form cylinder 4 by inserting the weld seam 2 into the fitting groove 5 or 6 (FIG. 2) and expanding it by means of compressed air. When the compressed air is removed, the printing form 1 adheres to the form cylinder 4 or 9 with a positive-locking engagement.

Figure 2:
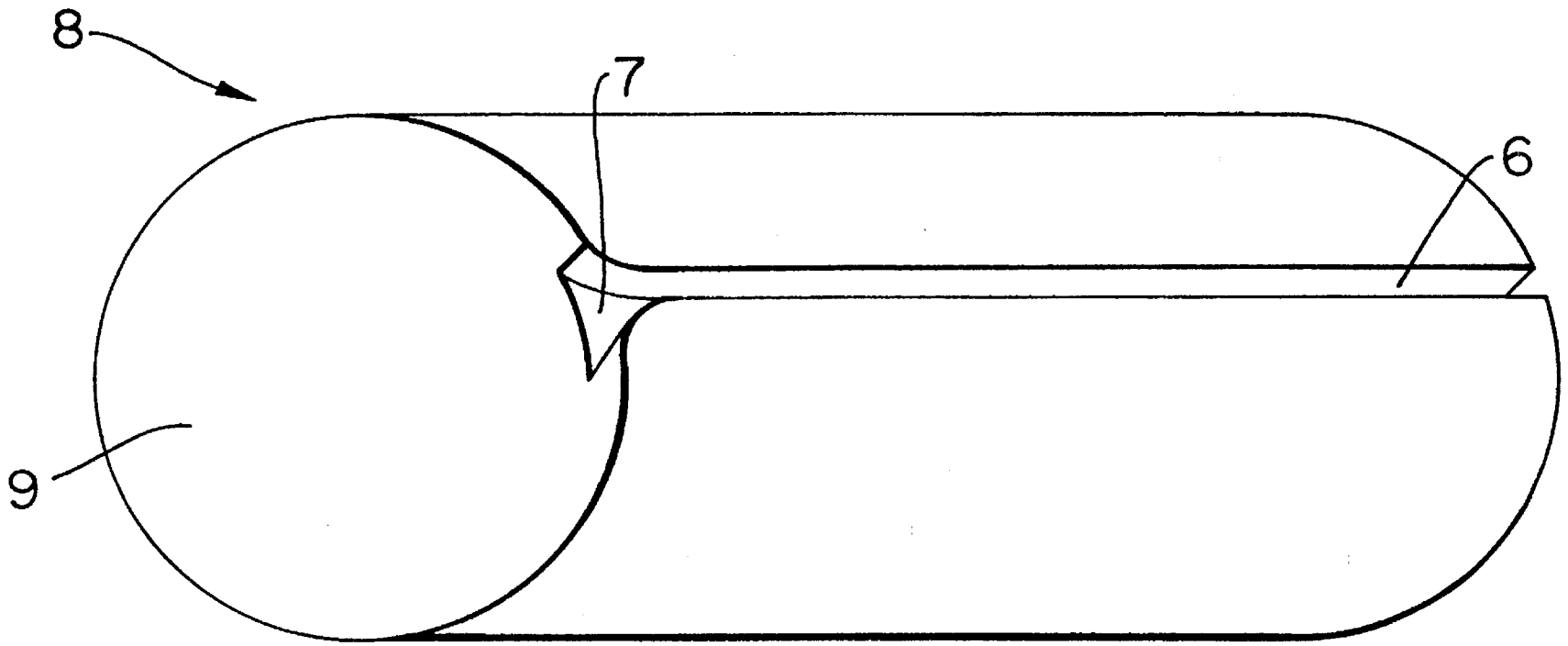
FIG. 2 shows a form cylinder which can be used in combination with the sleeve-shaped offset printing form.

In a particularly advisable construction, according to FIG. 2, a fitting groove 6 is provided on the surface of a form cylinder 9 having no clamping groove or clamping segment. This fitting groove 6 is provided with a funnel-shaped feed opening or entry 7 at least at one end side 8 which facilitates insertion of the weld seam 2 into the fitting groove 6 when drawing the sleeve 1 over the form cylinder 9. The fitting groove 6 also has a depth which is greater than the height of the wedge projection 3 of the weld seam 2 and the width is likewise equal at least to the maximum width of the wedge projection 3, but approximately corresponds to the width of the wedge projection 3.

Figure 3:
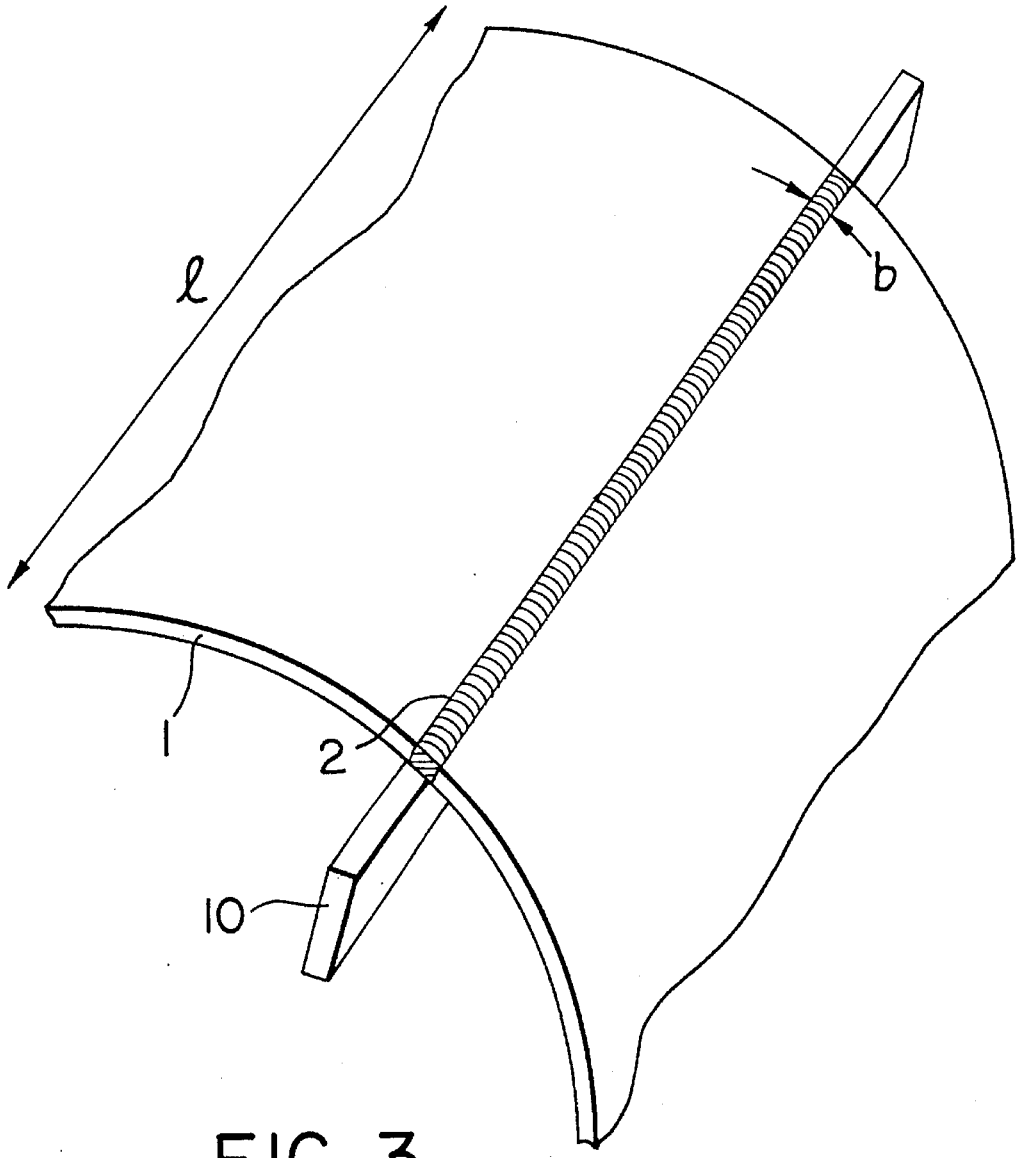
FIG. 3 shows a perspective partial view of a sleeve-shaped offset printing form with another embodiment of a register device according to the invention.

Although it is advantageous, as described above, to form the guide element from the weld seam 2 itself, a metallic web 10 can also be fastened at the inside of the sleeve at least partially along the width of the sleeve as an alternative to the weld seam, constructed in the manner shown in FIG. 3. The web 10 which is preferably rod-shaped can be connected with the weld seam itself, but may also be attached to the inside of the sleeve at an optional point in the axial direction. This fastening may be produced, for example, by means of a welded or glued connection.

Figure 4:
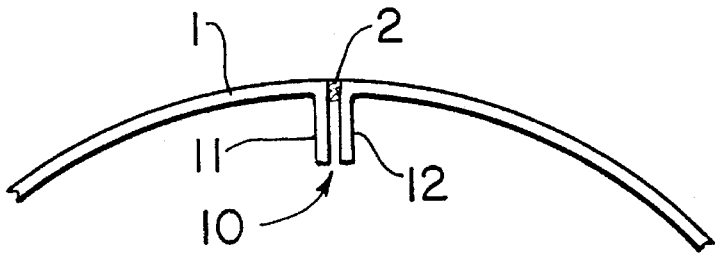
FIG. 4 shows a sectional view of a sleeve-shaped offset printing form with another embodiment of a register device according to the invention.

It is also possible, as shown in FIG. 4, to form the web 10 by bending or folding the beginning 11 and end 12 of the plate-shaped blank into the interior of the sleeve 1. The adjoining parts 11, 12 can be welded, glued or riveted together continuously or at points.

Another advantageous feature consists in securing the sleeve 1 on the form cylinder 4 against axial displacement by means of stops at the end sides which can be inserted into the fitting groove 5.

The invention is not limited by the embodiments described above which are presented as examples only but can be modified in various ways within the scope of protection defined by the appended patent claims.

We claim:

1. A register device in combination with a metallic sleeve-shaped offset printing form and a form cylinder of a printing press, the printing form having a beginning and an end that are connected with one another to form the sleeve, the register device comprising a guide element provided so as to project inside the sleeve at least along a part of the sleeve width, the guide element having a height, the form cylinder being provided with an axially extending fitting groove having parallel side walls and a depth that is greater than the height of the guide element, the fitting groove further having one end at which the sides diverge from one another in an axial direction so as to form a funnel-shaped entry for the guide element, the projecting guide element being insenable in its entirety into the fitting groove so that the sleeve can be slid onto the form cylinder and secured on the form cylinder in a circumferential direction.

2. A register device according to claim 1, wherein the beginning and the end of the printing form are connected together by a weld seam, the guide element being formed by the weld seam projecting inwardly of the sleeve.

3. A register device according to claim 2, wherein the projection of the weld seam has a wedge-shape along the entire width of the sleeve, the fitting groove being provided to extend along an entire width of the form cylinder.

4. A register device according to claim 1, wherein the guide element is formed as a web attached on the inside of the sleeve at least along a part of the width of the sleeve.

5. A register device according to claim 4, wherein the beginning and the end of the printing form are connected together by a weld seam, the web being connected with the weld seam.

6. A register device according to claim 4, wherein the guide element is formed by the beginning and the end of the printing form being bent toward the interior of the sleeve.

7. A register device according to claim 6, wherein the beginning and the end of the printing form are glued together.

8. A register device according to claim 6, wherein the beginning and the end of the printing form are welded together.

9. A register device according to claim 6, wherein the beginning and the end of the printing form are riveted together.

* * * * *